US009941080B2

(12) United States Patent
Demissy et al.

(10) Patent No.: US 9,941,080 B2
(45) Date of Patent: Apr. 10, 2018

(54) SELF-DEICING LIGHTWEIGHT CONDUCTOR

(71) Applicant: Alstom Technology Ltd., Baden (CH)

(72) Inventors: Daniel Demissy, St Bernard de Lacolle (CA); Pascal Babin, St-Jacques-le-Mineur (CA); Martin Leger, St-Lazare (CA); Clément Rollier, Montreal (CA); Riyad Kechroud, Longueuil (CA)

(73) Assignee: ALSTOM TECHNOLOGY LTD, Baden (CH)

( * ) Notice: Subject to any disclaimer, the term of this patent is extended or adjusted under 35 U.S.C. 154(b) by 84 days.

(21) Appl. No.: 14/780,591

(22) PCT Filed: Mar. 27, 2014

(86) PCT No.: PCT/EP2014/056124
§ 371 (c)(1),
(2) Date: Sep. 28, 2015

(87) PCT Pub. No.: WO2014/154786
PCT Pub. Date: Oct. 2, 2014

(65) Prior Publication Data

US 2016/0055997 A1 Feb. 25, 2016

(30) Foreign Application Priority Data

Mar. 28, 2013 (FR) ..... 13 52841

(51) Int. Cl.
*H01H 31/28* (2006.01)
*H01H 1/42* (2006.01)
*H01H 31/02* (2006.01)

(52) U.S. Cl.
CPC ..... *H01H 31/28* (2013.01); *H01H 1/42* (2013.01); *H01H 31/026* (2013.01); *H01H 2205/002* (2013.01)

(58) Field of Classification Search
CPC ..... H01H 1/06; H01H 1/42; H01H 2203/024; H01H 31/28; H01H 31/026; H01H 2031/286; H01H 2205/002
(Continued)

(56) References Cited

U.S. PATENT DOCUMENTS

2013/0092517 A1* 4/2013 Demissy ..... H01H 31/026 200/48 KB
2014/0368193 A1 12/2014 Morales
2016/0084925 A1 3/2016 Le Prado

FOREIGN PATENT DOCUMENTS

EP 1 863 039 A2 12/2007
GB 2 095 891 A 3/1981
WO WO2013/018922 * 1/2013 ..... H01H 1/06

OTHER PUBLICATIONS

Search Report issued in French Patent Application No. FR 13 52841 dated Dec. 4, 2013.

(Continued)

*Primary Examiner* — Ahmed Saeed
(74) *Attorney, Agent, or Firm* — Pearne & Gordon LLP

(57) ABSTRACT

The invention relates to a conductor (2) for electrical equipment, the conductor comprising at least one hollow section member (2) of electrically conductive material that is elongate along a longitudinal axis (Y), the conductor having an outside surface in which at least a portion forms corrugations (23, 24) in a plane perpendicular to the longitudinal axis. The conductor may advantageously form a movable contact (blade) (2) of a high voltage disconnector.

21 Claims, 6 Drawing Sheets

(58) Field of Classification Search
USPC ..... 200/238, 275, 279, 48 A, 48 KB, 48 P, 200/254, 244, 253
See application file for complete search history.

(56) References Cited

OTHER PUBLICATIONS

International Search Report issued in Application No. PCT/EP2014/056124 dated Jun. 6, 2014.
Written Opinion issued in Application No. PCT/EP2014/056124 dated Jun. 6, 2014.

* cited by examiner

SELF-DEICING LIGHTWEIGHT CONDUCTOR

TECHNICAL FIELD AND PRIOR ART

The present invention relates to a conductor for electrical equipment, and in particular to a movable contact for a disconnector in air-insulated installations for transmitting and distributing high voltage electricity.

More generally, the invention also relates to a switch for air-insulated installations for transmitting and distributing high voltage electricity.

The main intended field of application is high voltage, but the invention is equally applicable to a medium or low voltage conductor.

The invention relates more particularly to reducing the weight of such a conductor.

A high voltage electricity substation comprises in particular a set of circuit breakers and disconnectors.

In a substation, a disconnector performs a safety function: it is opened after the circuit breaker has opened in order to make any intervention on the substation safe.

In known manner, a disconnector comprises a stationary contact and a contact that is movable in pivoting about an axis, which movable contact is usually referred to as a "blade".

When the disconnector is closed, the movable contact and the stationary contact are in mechanical and electrical contact with each other.

The movable contact is in a substantially horizontal position when the disconnector is closed and in a substantially vertical position when the disconnector is open.

The stationary contact is made up of a set of interconnected parts within which the movable contact is received when it is moved.

Such a disconnector gives satisfaction in terms of operating safety, and the effectiveness with which it conducts current.

In International patent application WO 2010/106126, the applicant has proposed such a high voltage disconnector that is also of simplified design.

The need to withstand high levels of mechanical stress when the movable contact needs to be operated together with extra weight due to ice requires equipment that operates when iced to be reinforced compared with the specifications for equipment that is to operate without ice. In other words, for utilization under winter conditions where ice might form, it is necessary to over-dimension the mechanical parts that are used for actuating the movable contact. However that greatly increases the cost price of the equipment.

Furthermore, the need to comply with high levels of thermal stress requires the designers of a disconnector two over-dimension the movable contact relative to its specifications in terms of conducting current.

More exactly, the designers need to increase the right section of the movable contact. In so doing, the right section of said contact is increased so its electrical resistance is decreased, thereby preventing the contact from heating.

However, increasing the right section of the movable contact (the blade) leads to an increase in its weight.

A disconnector must also be capable of withstanding a high level of seismic activity. Unfortunately, the heavier the parts that are used to make it, the poorer the ability of a disconnector to withstand seismic activity.

In summary, the following constraints need to be confronted:

- in normal operation, any temperature rise to which a high voltage (HV) disconnector is subjected must be limited to a threshold;
- a disconnector must also be capable of operating when subjected to a certain level of stress due to the weight of ice, which weight can be considerable; and
- a disconnector must also withstand certain seismic constraints, and they too can be considerable.

It has been found that the weight of the blade, i.e. of the movable contact of the disconnector, in particular when it is weighed down by ice, is a factor that is harmful, leading to the disconnector breaking when it needs to operate under a weight of ice and when it is subjected to earthquakes (with or without ice) and it is in the open position.

There is therefore the problem of reducing the weight of the conductor as much as possible, while also dissipating any ice that might be deposited thereon.

There is also the problem of reducing the weight of the blade of a high voltage disconnector as much as possible, without thereby causing it to overheat during operation of the disconnector.

An object of the invention is thus to propose electrical equipment, more particularly a disconnector of the type described above, that makes use of parts that are lighter in weight, in particular a movable contact that is lighter than the movable contacts of electrical equipment in the prior art.

Such equipment should preferably accommodate high levels of thermal stress and should be capable of operating, when iced, using mechanical parts that are smaller, and therefore less expensive, while nevertheless providing operation that is satisfactory under icing conditions in winter.

SUMMARY OF THE INVENTION

To do this, the invention provides a conductor for electrical equipment comprising at least one section member of electrically conductive material that is elongate along a longitudinal axis (Y), the conductor having an outside surface in which at least a portion forms corrugations in a plane perpendicular to the longitudinal axis, which corrugations also extend on said outside surface along a direction that is parallel to the longitudinal axis (Y).

The invention also provides a conductor for electrical equipment, the conductor comprising at least one section member of electrically conductive material that is elongate along a longitudinal axis (Y), the conductor having an outside surface in which at least a portion forms fluting or grooves that extend in a direction parallel to the longitudinal axis.

The corrugations or fluting or grooves lengthen the perimeter of the outside surface and increase the surface area for dissipating heat energy from the section member to the ambient air or to any ice (and/or snow) that has become deposited thereon.

They serve to cause current to flow in non-uniform manner, creating localized heating on the outside surface, which heating is compensated by convection of the ambient air.

It should be recalled that the phenomenon of natural convection consists in heat being transferred from a solid body (here: the conductor) and the freely-moving surrounding air.

The transmission of heat to the surrounding air, due to the Joule effect that results from current flowing in the conductor, has the effect of causing the density of the air to vary. Air is thus caused to flow because of buoyancy thrust. It is therefore this thrust force due to varying air density that is at the origin of the natural convection, which is also said to be "free" convection, that takes place around the conductor.

With such a conductor, disengagement of ice involves several physical phenomena.

Firstly, thermal conduction between the conductor and the ice (and/or the snow) causes a portion of it to melt, which portion therefore runs off as water.

In addition, the portion of the ice (or of the snow) that is directly in contact with the conductor, and that is transformed into water, itself acts as a lubricant, thereby facilitating mechanical disengagement of the ice (and/or of the snow) that remains when the body that retains it begins to move.

Water evaporation tends rather to cool the blade using the above-mentioned lubricating water. This water has remained on the body of the conductor and it evaporates because of heat exchange. Coupled with the phenomenon of air convection, the water vapor serves to remove even more heat energy than can be removed by the convection phenomenon alone.

The undulations or the fluting or the grooves form a surface that can become clogged by ice (and/or snow). This leads to that surface becoming heated because natural convection is prevented, while improving the conduction of heat energy to the ice. In other words, ice (and/or snow) on the conductor prevents air convection. However, by becoming deposited directly on the portion of the conductor where it is locally heated, it absorbs the heat that would otherwise be dissipated into the air.

Compared with the prior art, the effects of disengaging any ice (or snow) enable the weight of the conductor to be reduced, for given ice (and/or snow) conditions.

The invention thus enables the weight of the blade of a conductor to be reduced, and in particular the weight of a high voltage disconnector blade. Consequently, it serves to reduce the stresses to which the mechanical parts actuating the conductor are subjected under ice (and/or snow) conditions. The invention is thus adapted to systems that perform de-icing by injecting high currents.

For given conductor diameter, the corrugations or the fluting or the grooves enable the heat transfer surface area involved in convection and/or radiation to be increased; under such circumstances, the section member may be anodized.

Furthermore, a rounded shape for the corrugations or the fluting or the grooves makes the conductor more aerodynamic by contributing to better airflow.

It is preferable for the corrugations or the fluting or the grooves to be of rounded shape so as to avoid the point effects that are inherent to fins of triangular and/or rectangular shape of the kind usually used in the industry, thereby reducing dielectric stresses at high voltage.

The outside surface of the conductor may be provided with corrugations that are simple and/or complex. As an example of complex corrugations, mention may be made of corrugations having fractal geometry, comprising main corrugations, each of which is provided with secondary corrugations.

The conductor is hollow inside, the hollow being of cylindrical shape over all or part or, or most of the length of the conductor.

The cylinder may have an inside diameter lying in the range 2.5 centimeters (cm) to 7.5 cm, or even 10 cm.

The thickness of the ring may lie in the range 5 millimeters (mm) to 2.5 cm.

The conductor of the invention is particularly adapted to making a movable contact for a disconnector.

Preferably, the conductor has two support elements that are spaced apart from each other along a longitudinal axis.

More preferably, each of the support elements is arranged at one of the longitudinal ends of the conductor.

According to an advantageous characteristic, a conductor of the invention includes at least one electrical contact element for coming into contact with a distinct electrical contact in order to provide an electrical connection. Each contact element can then be fastened to the corrugated section member of the conductor. When there are two electrical contact elements, the corrugations are shared between the contact elements.

A conductor as described above may further include at least one lateral projection extending beyond the outside surface of the conductor in said plane perpendicular to the longitudinal axis.

Each lateral projection may have an outside surface with a portion provided with corrugations in a plane perpendicular to said longitudinal axis.

Each lateral projection may have an outside surface with a portion that is plane.

Each lateral projection may provide electrical contact or may be provided with a part for providing electrical contact.

Two lateral projections may be provided that are arranged symmetrically on either side of a plane of symmetry of the conductor.

For simplicity of fabrication, the section member is preferably made by extrusion.

It is preferably made of aluminum or of copper or of aluminum or copper alloy.

A conductor of the invention may be provided with pivot hinge means at one of its ends.

A conductor of the invention may include at least one lateral reinforcement means. Said means may be provided with a hollow or a recess that is open towards the hollow, or towards the hollow portion, of the conductor.

The invention also provides high voltage electrical equipment including at least one conductor of the invention and at least one electrical contact with which said conductor is suitable for coming into contact.

In such electrical equipment, at least one of the electrical contacts may have a plurality of separate contacts with which a common lateral portion of said conductor can come into contact.

The conductor of the invention may be stationary, said electrical contact being a movable contact.

In a variant, the conductor of the invention is movable, said electrical contact being a stationary contact.

The invention also provides such electrical equipment in which said electrical contact is U-shaped.

Each branch of the U-shape may include at least one stationary contact extended by a tab folded inwards so as to be substantially parallel to the branch of the U-shape that it extends, said tab being designed to come into mechanical contact with at least one contact element of the movable contact.

Return means may be interposed between the tab and the branch of the U-shape it extends, in order to urge the tab inwards towards the movable contact when it is in contact with the stationary contact.

The invention also provides a high voltage disconnector including electrical equipment as described above.

The invention also provides a high voltage disconnector including an electrical conductor as described above that is mounted by pivotal hinging on an insulating support, and at least one electrical contact with which said conductor is suitable for coming into contact by a pivoting movement e.g. on an insulating support.

The invention also provides an operating method for operating a conductor or electrical equipment or a disconnector of the invention, wherein current flows from one end of the conductor to the other, giving off heat by the Joule effect in its wall. Ice and/or snow that has accumulated in the corrugations or fluting or grooves can then melt effectively.

BRIEF DESCRIPTION OF THE DRAWINGS

The invention can be better understood with the help of the following description and of the accompanying drawings, in which.

DETAILED DESCRIPTION OF PARTICULAR EMBODIMENTS

The description below relates to a conductor of the invention.

A particular application relates to it being used in a high voltage disconnector. However the conductor of the invention may be used in any type of electrical equipment in which a conductor is required. In addition, the conductor is described as being movable; however a conductor that is stationary does not lie outside the ambit of the present invention.

Figure 1A:
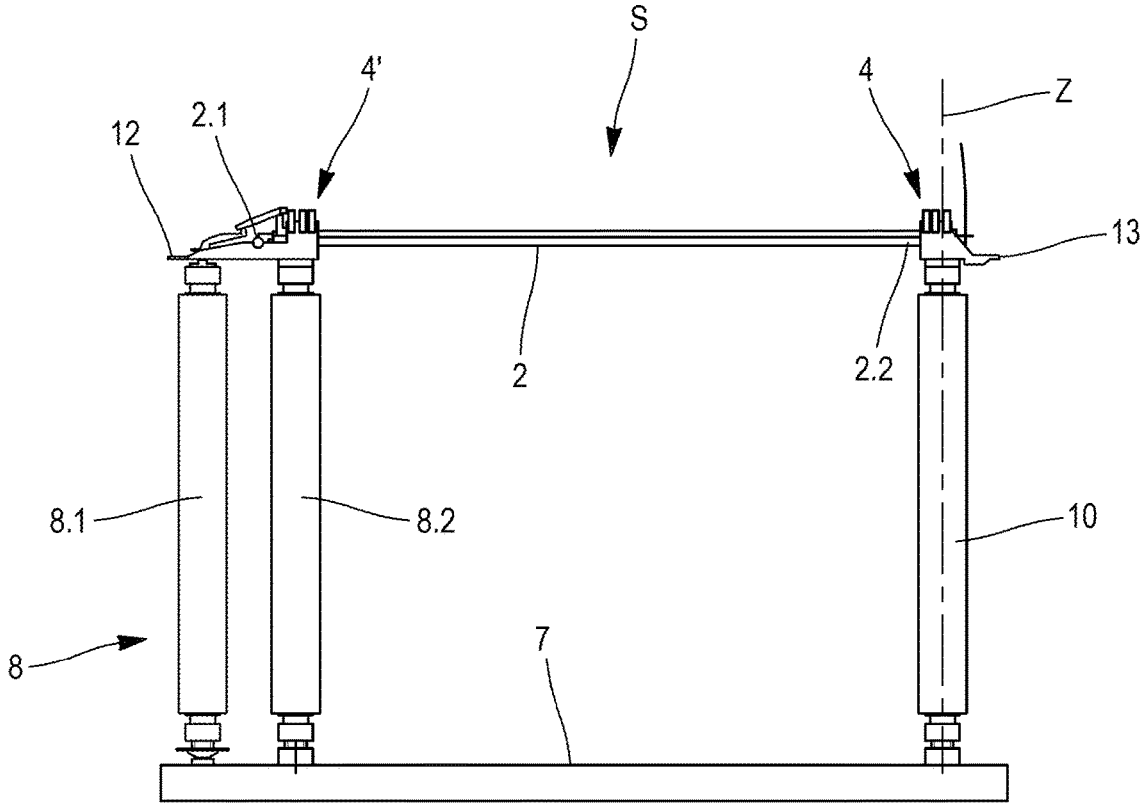
FIG. 1A is a side view of an embodiment of a disconnector of the present invention in the closed position.
Figure 1B:
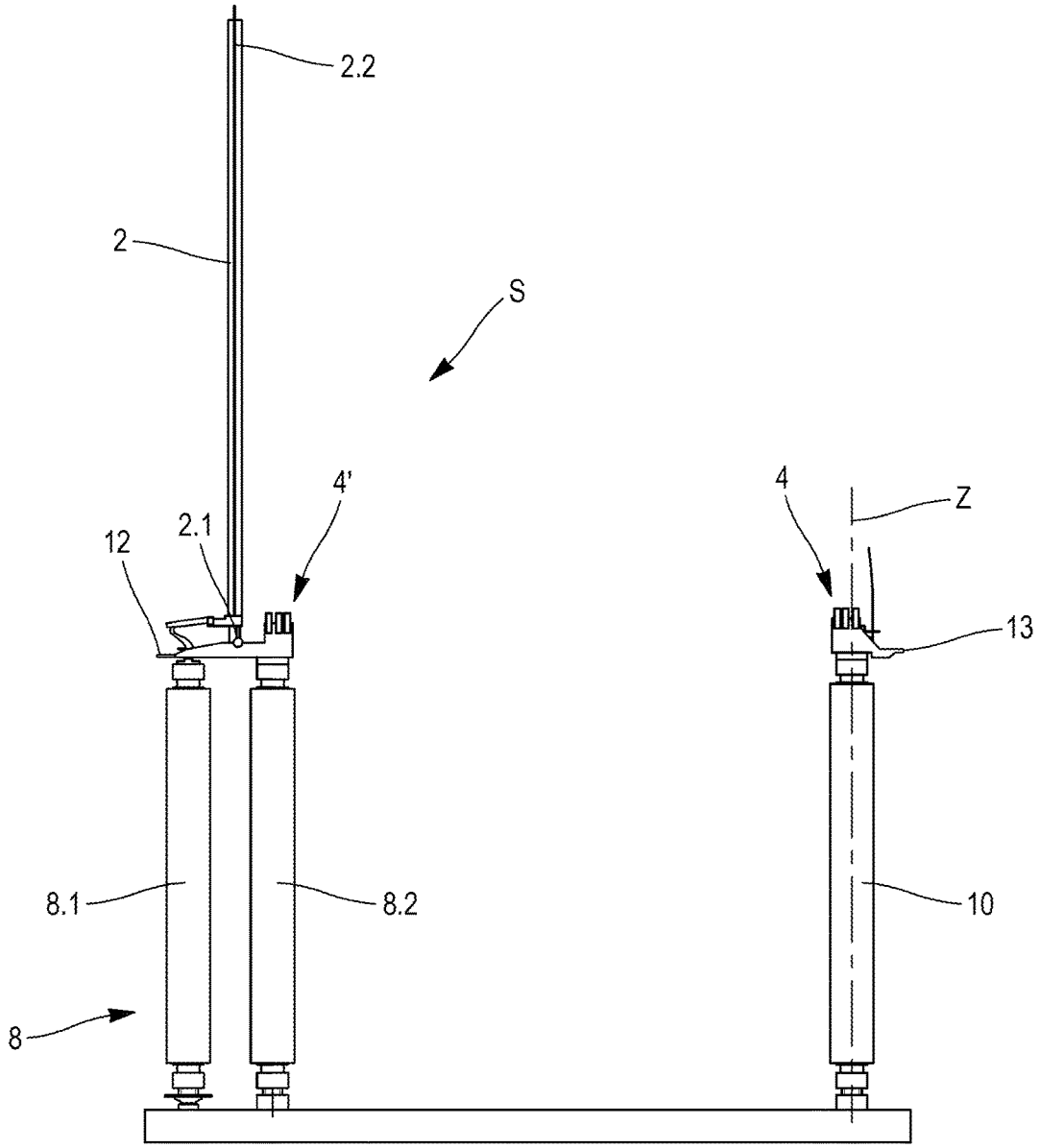
FIG. 1B is a side view of the FIG. 1A disconnector, but in the open position.

In FIGS. 1A and 1B, there can be seen an example of a high voltage disconnector S, e.g. for a voltage of about 245 kilovolts (kV), to which the conductor of the invention may be applied.

This disconnector S comprises a movable contact 2 formed by a conductor of the present invention that is elongate along a longitudinal axis. Two stationary contacts 4 and 4' are arranged on insulating supports 8 and 10 that enable them to be held at a distance from the ground or from a support 7. Each of the stationary contacts is designed to be in mechanical contact with a respective one of the ends of the movable contact.

One of the stationary contacts 4' is mounted on the insulating support 8, while the other stationary contacts 4 is mounted on the insulating support 10.

In the example shown, the insulating support 8 of the movable contact 2 is made up of two columns 8.1 and 8.2. The insulating support 10 is made up of a single column. Each column is arranged perpendicularly to the ground or to the surface of the support 7.

In a high voltage disconnector S, the movable contact 2 is commonly called a "blade". In this example it is mounted to pivot about an axis that is substantially orthogonal to the plane of the figure, in order to cause the disconnector to pass from a closed position (conductor in a substantially horizontal position, FIG. 1A) to an open position (conductor in a substantially vertical position, FIG. 1B).

More exactly, it is hinge-mounted on the insulating support 8. It is this support that supports the hinge mechanism of the movable contact 2.

In the description below, and by convention, a reference frame is defined having three mutually orthogonal axes X, Y, and Z, with the axis Y being the longitudinal axis of the conductor 2 when the conductor is in the closed position.

The stationary axis Z is in alignment with the direction of the insulating support 10, and it is perpendicular to the ground or to the horizontal surface of the support 7. It is in alignment with the vertical direction at the location where the device is installed.

The axis X is perpendicular to the axes Y and Z.

Figure 2A:
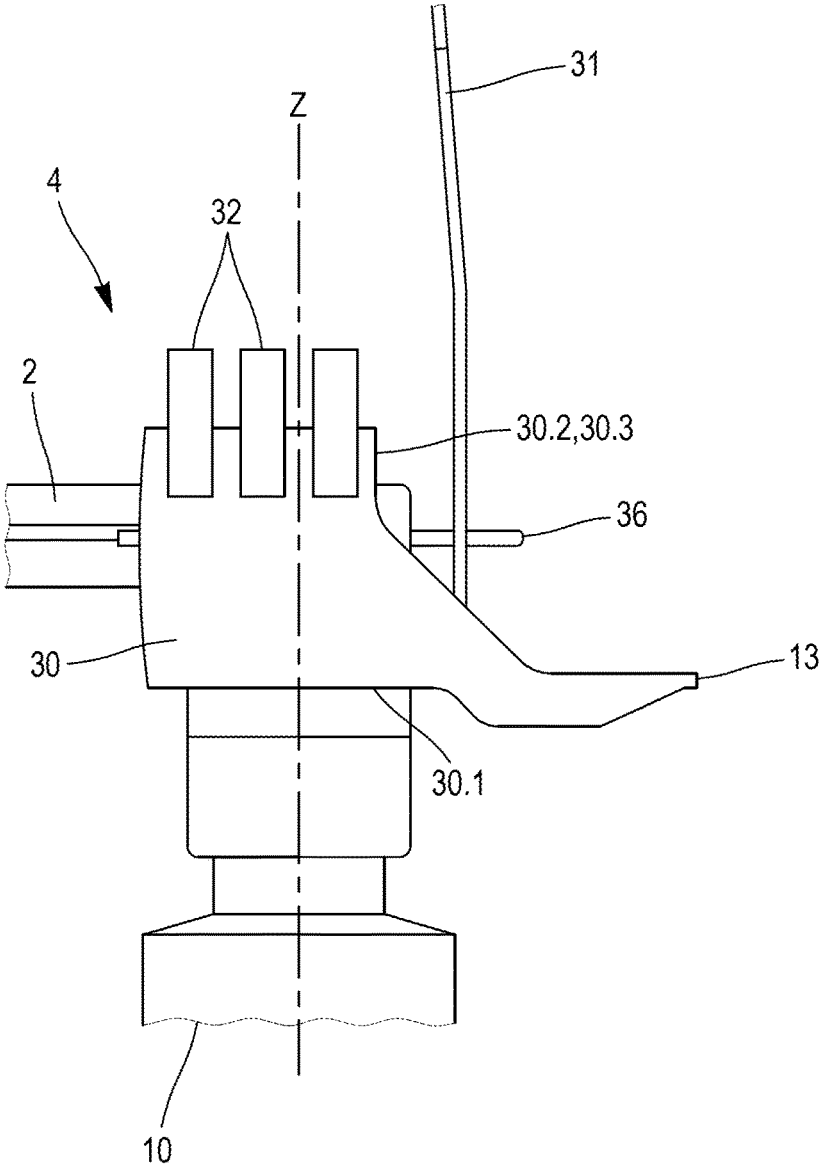
FIGS. 2A, 2B, and 2C are enlarged views respectively from the side, from above, and end-on from the right-hand side showing the stationary contact of the high voltage disconnector S of FIGS. 1A and 1B.
Figure 2B:
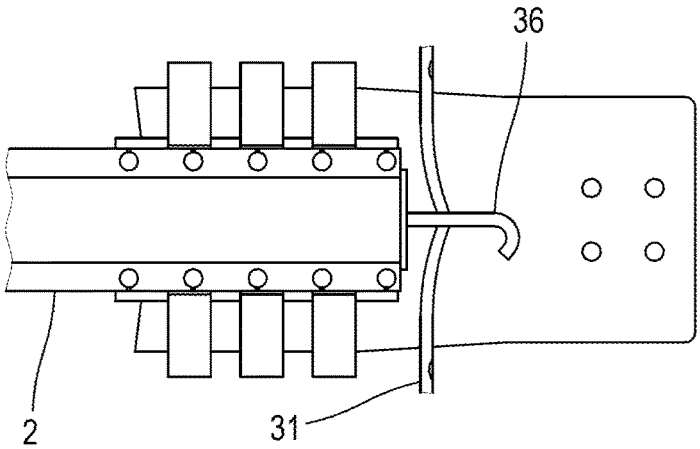
Figure 2C:
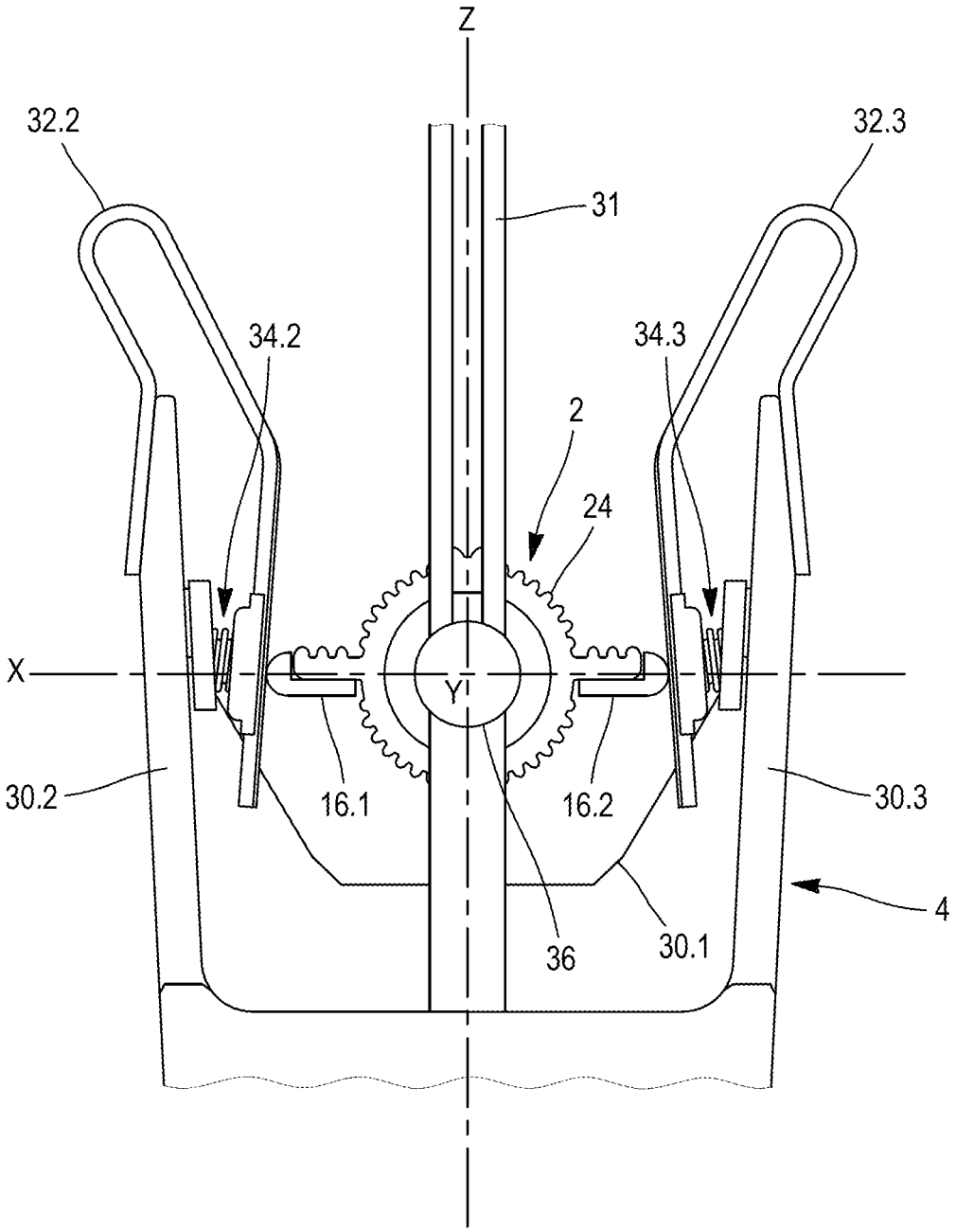

In FIG. 2C, the axis X is the axis that is directed horizontally and the axis Z is the axis that is directed vertically.

In other words, in the closed position (FIG. 1A), the conductor 2 co-operates with the stationary axes X and Z to define an orthogonal system of axes X, Y, and Z.

In the disconnector S that is shown, the movable contact 2 of the invention is electrically connected to a high voltage electricity network via a distinct electrical contact and a connection 12 that extends substantially horizontally.

The stationary contacts 4 are connected to the network via a connection 13 of structure similar to that of the connection 12.

Thus, when the disconnector S is in the closed position (FIG. 1A), current coming from the high voltage distribution network can pass from one of the connections, e.g. the connection 12, to the other connection, e.g. the connection 13.

The invention also applies to a disconnector having only one stationary contact 4.

The mechanism for actuating the disconnector is of conventional type and is not described in detail. In an example, it includes a spiral tape spring for balancing the blade 2 of the disconnector. The insulating column 8.1 also forms a control rod for controlling the movement of the moving contact or blade 2.

In the example shown, the two stationary contacts 4 and 4' are similar in structure: as a result only one of them is described in detail below.

Such a stationary contact 4 is of substantially U-shaped section forming a jaw, with its two branches being substantially parallel and electrically conductive. These two branches define a gap in which the movable contact 2 is positioned when the disconnector is in the closed position, electrical conduction taking place between the movable contact and the parallel branches.

More exactly, and as can be seen in FIGS. 2A and 2C, the stationary contact 4 comprises a U-shaped part 30, this part being fastened to the insulating support 10 via its bottom 30.1. It has two branches 30.2 and 30.3 that are substantially parallel to each other, with the movable contact 2 in the closed position being positioned between them.

Each branch 30.2 and 30.3 is extended by a respective inwardly-folded tab 32.2 or 32.3 that is to come into contact with a contact element 16.2 or 16.1 of the movable contact 2, as described below.

The branches 30.2 and 30.3 of the U-shape are made out of aluminum or of aluminum alloy, for example. The tabs 32.2 and 32.3 may be made of silver-plated copper.

Resilient means 34, e.g. respective coil springs 34.2, 34.3, are advantageously provided between each tab 32.2, 32.3 and the corresponding branch 30.2, 30.3, thereby urging the tab 32.2, 32.3 towards the inside of the stationary contact.

This improves electrical contact between the tab and the corresponding contact element of the movable contact.

In the example shown, the tabs 32.2, 32.3 are fitted to the respective branches 30.2, 30.3 by screw fastening.

The movable contact 2 of the present invention is described below in greater detail with reference more particularly to FIGS. 3 and 4A, 4B.

The movable contact 2 of the invention is much lighter in weight than the contacts that have been used in the past in high voltage disconnectors used when ice-free and when iced, while nevertheless allowing electric current to pass between the connections 12 and 13.

Figure 3A:
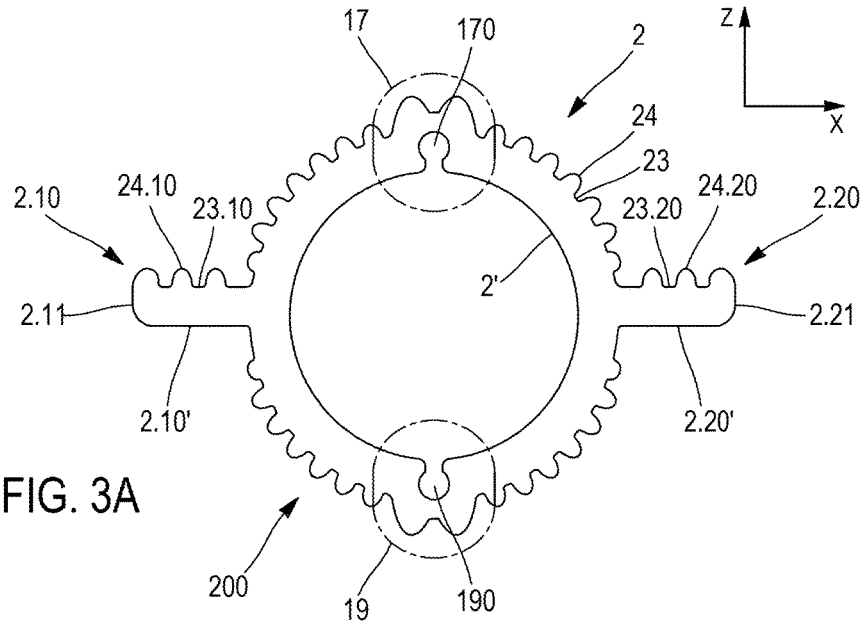
FIG. 3A is a cross-section view of a conductor in an embodiment of the invention and without a contact element.
Figure 3B:
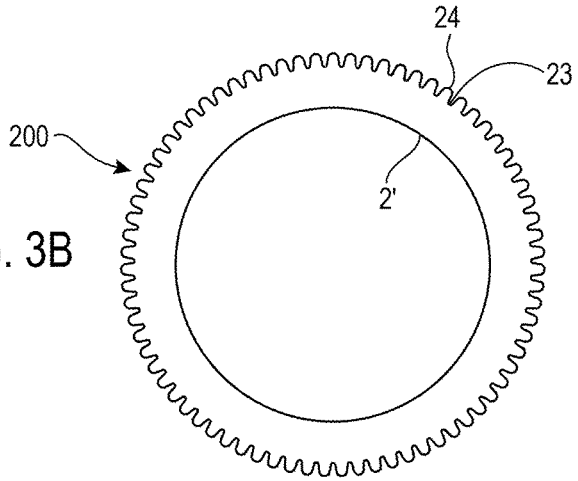
FIG. 3B is a cross-section view of a conductor in a variant embodiment of the invention and without a contact element.

FIGS. 3A and 3B are both cross-section views (on the X,Z plane) of a conductor 2 of the invention, mounted as the movable contact of the high voltage disconnector in the example of above-described FIGS. 1A and 1B.

By way of example, each cross-section is taken on the side of the end 2.2 of the conductor 2 in a zone outside the zone including the contact branches of the stationary contact 4. The conductor is hollow, having an inside surface 2'.

The device shown in cross-section in FIG. 3A, including zones reinforced by lateral reinforcement means 17, 19, is adapted to operate with a relatively high current, e.g. about 3000 amps (A). Preferably, it is used for voltages below 115 kilovolts (kV) or 150 kV or 200 kV, because it is more sensitive to radio interference than the device shown in FIG. 3B.

Each of the lateral reinforcement means 17, 19 may be made along the length of the conductor.

It contributes to passing the flow of current, and also to cooling.

The device shown in cross-section in FIG. 3A, without a reinforced zone 17, 19, is adapted to operate with a lower current, e.g. about 2500 A, but may be used at a higher voltage, greater than 115 kV or 150 kV or 200 kV.

In each cross-section, the movable conductor (or blade) 2 includes corrugations 23, 24 over at least a fraction of its outside periphery, or indeed over nearly all of its outside periphery. The bottom zone 200 is preferably also provided with corrugations; this then can become clogged with ice when the equipment is in the open position. On being closed, heating will then give rise to the same effects as those described above.

In the structure of FIG. 3A, saw cuts or "kerfs" may be provided in the zones 17 and 19 in order to create a chimney effect; they serve to improve cooling. These kerfs may be placed along a vertical axis, passing through the zones 17 and 19, and for example joining both hollows or recesses 170, 190.

In this same structure, the reinforced zone(s) 17, 19 having outermost portions that project beyond the outside diameter defined by the tops of the corrugations 24, serve to protect these kerfs dielectrically.

The notches 170, 190, which are open towards the inside of the conductor, make it possible to fasten a plate to the end of the blade, said plate being perpendicular to the axis of the hollow conductor, and also to fasten the blade to the contact 4' at the end 2.1 (e.g. likewise using two screws). A plate perpendicular to the axis of the hollow conductor may for example have two holes in alignment with the inside recesses 170, 190 of the extrusion, making it possible to block the hollow of the conductor using two screws, e.g. self-tapping screws, that enable said plate to be fastened to the end of the hollow tube.

Figure 4A:
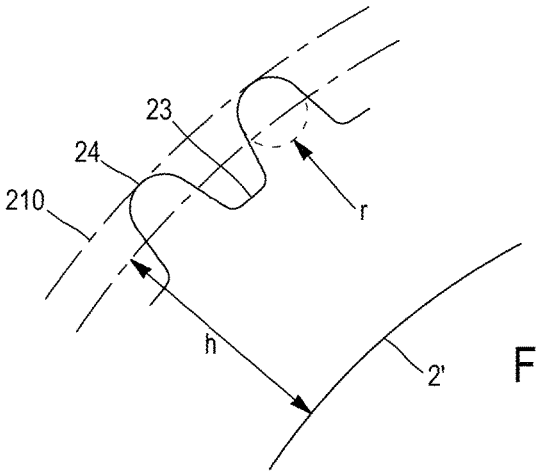
FIG. 4A shows a detail of the cross-section view of a conductor in an embodiment of the invention.

As can be seen in greater detail in FIG. 4A, the corrugated outside surface of the conductor has alternating portions 23 and 24 that are low and high relative to the inside surface 2'. The high portion 24 preferably presents a profile that is rounded, close to a portion of a circle of radius r. By way of example, r is less than or equal to 3 mm, still by way of example: r=1 mm or r=1.5 mm. The low portions do not need to have this rounded shape.

In other words, the outside surface of the conductor presents an altitude h relative to the inside surface 2' that varies between a minimum value $h_{min}$ that corresponds to the lowest zones 23, and a maximum value $h_{max}$ that corresponds to the highest zones 24. The difference $h_{max}-h_{min}$ between these two values preferably lies in the range 6.5 mm to 9.5 mm, and more generally between 5 mm and 2.5 cm. The diameter of the cylinder defined by the inside surface 2' may for example lie in the range 2.5 cm and 7.5 cm.

Figure 4B:
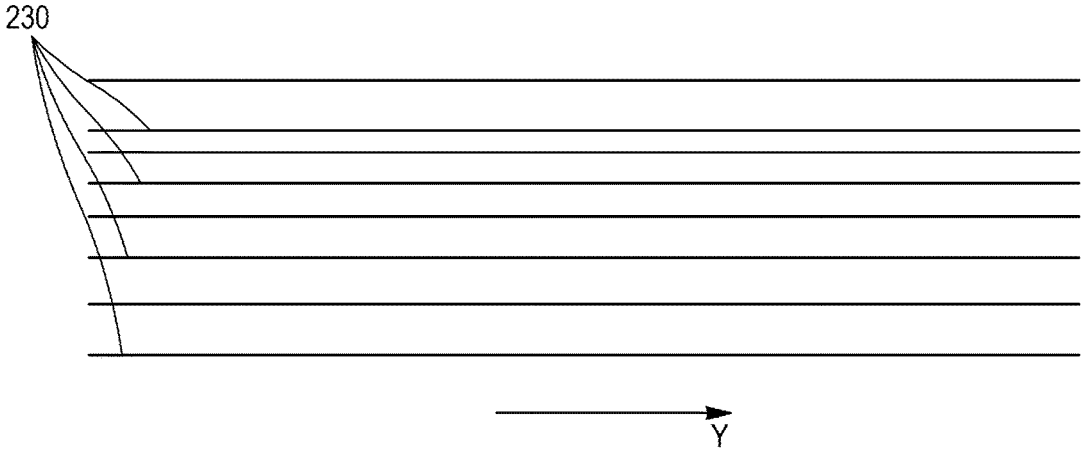
FIG. 4B is a profile view of a conductor in an embodiment of the invention.

In other words, and as can also be seen in FIG. 4B, which shows a portion of the outside surface of the conductor in side view, this outside surface presents corrugations or fluting or grooves 230 that extend longitudinally, parallel to the axis Y, over a fraction of the length (along Y) of the conductor, or even over its entire length.

As can be understood from FIG. 4A, the corrugations create a perimeter that is longer than the perimeter that would result from a smooth outer profile 210 (drawn in interrupted lines in FIG. 4A). The outside surface area of the conductor is thus likewise greater than the surface area that would result from a smooth surface of the kind marked in this figure by the trace 210.

Such a topology creates a "radiator" effect and encourages heat exchange with ambient air. This increases the effectiveness of the conductor by several tens of percent, e.g. by at least 50%, in particular when the blade is exposed to wind or rain.

In addition, if a rounded shape is selected from the corrugations (as shown in FIG. 4A), high voltage dielectric stresses are reduced, in contrast to other shapes such as triangular or rectangular shapes of the kind usually to be found in conventional radiators.

In the event of ice and/or snow accumulating, the corrugations that are responsible for the dissipation effectiveness of the conductor find themselves clogged by that ice and/or snow. More precisely, the ice and/or the snow accumulates in the low portions 23 of the corrugations (FIG. 4A). Consequently, the high percentage of heat dissipation that would normally take place in air, now takes place in the ice and/or the snow, thereby encouraging it to dissipate, where the presence of such ice and/or snow is harmful to and mechanically stresses the operation of the disconnector.

In conventional blades, reliance tends to be made on having a conductor of large section in order to reduce its electrical resistance and thus avoid any electrical heating, instead of relying on a larger convective and/or radiative surface area for heat exchange with ambient air in order to dissipate the heat; any ice and/or snow that is deposited then receives very little heat energy and therefore does not melt. By way of example, a conductor of the invention has an outside diameter of 101.6 mm and an inside diameter of 85.4 mm.

The corrugations may be simple, as shown in FIG. 3A or 3B; in a variant, it is also possible for them to be complex, for example they could present fractal geometry; each individual corrugation is then provided with secondary corrugations at its periphery.

The conductor described herein is thus easy to incorporate in systems for de-icing electricity networks.

By way of example, the section member 2 is made of aluminum or of copper or of an aluminum or copper alloy.

It may be obtained by an extrusion technique.

The conductor 2 is of generally elongate shape, being hinged at one of its longitudinal ends 2.1 on the first insulating support 8.

Its other longitudinal end 2.2, remote from its end 2.1, may be provided with one or two (or more than 2) lateral projections 2.10, 2.20 that extend(s) beyond the outer periphery of the conductor, and that serve(s) to provide electrical contact, e.g. by coming directly into contact with a stationary contact 4 arranged on the insulating support 10. These lateral projections 2.10, 2.20 may be made using the body of the conductor.

The corrugations 23, 24 are distributed over the outside surface of the conductor, between these lateral projections.

As can be seen in FIGS. 2C and 3A, a portion of the outside surfaces of these lateral projections, preferably in their top surfaces (that face upwards when the contact is in the closed position, as shown in FIGS. 1A and 2C) may in itself also be provided with corrugations in cross-section, having alternating portions 23.10, 24.10 and 23.20, 24.20 that are high and low relative to a plane surface. The high portions are preferably of rounded profile, close to a portion of a circle of radius r, which may be comparable to that described above for the corrugations 24, e.g. r=1.5 mm.

These corrugations are preferably distributed over a portion that is not intended to provide directly the electrical contact itself.

They have the same effect as that described above for the corrugations on the body of the conductor.

As in FIG. 4B, these corrugations define corrugations or fluting or grooves extending parallel to the axis Y.

Figure 5:
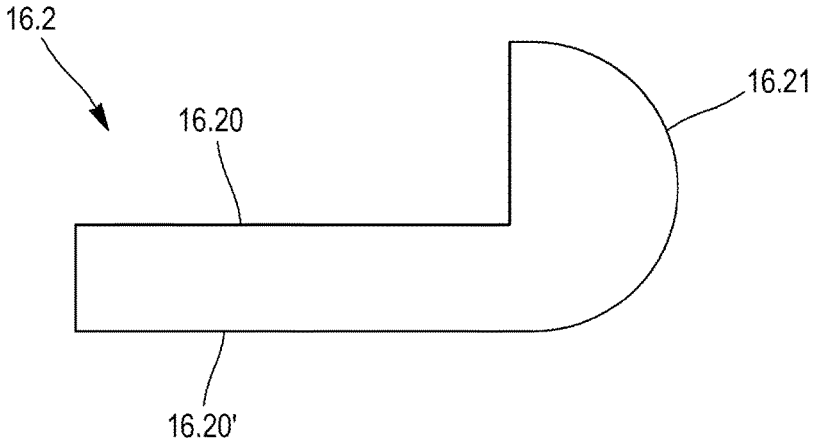
FIG. 5 is a side view of a lateral contact element for a conductor of the invention.

Contact elements 16.1, 16.2 may be provided for pressing against these lateral projections. By way of example these may be extrusions. As shown in FIG. 5, they are of elongate shape, having a top surface 16.20 and a bottom surface 16.20', with a plane or rounded lateral end 16.21 for providing the electrical contact itself with the corresponding portions of the contact 4. They come into contact against the projections 2.20, 2.10, e.g. by pressing the top surface 16.20 against the bottom surface 2.20' of the lateral projection. FIG. 5 shows the contact element 16.2, and a similar description is applicable for the contact element 16.1 and the corresponding lateral projection.

These contact elements 16.1, 16.2 may be assembled onto each of the portions 2.10, 2.20, e.g. by bolts.

The arrangement of these contact elements 16.1, 16.2 on the section member 2 is shown in FIGS. 2B and 2C, which show the physical contact between the stationary contact elements and the contact elements 16.1, 16.2 of the movable conductor 2 of the invention, when a disconnector is in the closed position: each of the contact elements 16.1, 16.2 is pressed against one of the tabs 32.2, 32.3 of the stationary contact 4.

In FIG. 2C, there can be seen only two contact elements 16.1, 16.2 and two branches 30.2, 30.3 of the stationary contact 4. The movable contact 2 of the invention may include two contact elements 16.1 and 16.2 at each of its ends. Each of these contacts 16.1, 16.2 may be associated with one to five contacts such as the contacts 32 (FIG. 2A), with which the contact 16.1 16.2 comes into electrical contact.

Each of the two contact elements 16.1, 16.2 of the movable conductor 2 may be provided with a length (along the axis Y) that is sufficient to extend over the length of a plurality of stationary contacts 32, e.g. about five such stationary contacts. This ensures permanent contact between the stationary contact 4 and the movable conductor 2, even in the event of movement by short circuit along the axis Y.

Stationary contacts having some other number of contact branches would not go beyond the ambit of the present invention.

The contact elements 16.1, 16.2 are preferably made of silver-plated copper.

The first longitudinal end 2.1 of the section 2 may also include contact elements for co-operating with the other stationary contact 4' that is arranged on the other insulating support 8.

The general operation of the disconnector of the present invention is similar to that of a disconnector of conventional type, and it is not described herein in detail. Reference may advantageously be made to the patent application WO 2010/106126 mentioned in the introduction, in particular for an explanation about how short circuit current flows from the movable contact towards the stationary contact by passing via the two contact elements 16.1, 16.2 when the disconnector is closed.

In the example shown in FIGS. 3A, 3B, the movable contact 2 of the invention is rigid as a result of its tubular shape. Thus, it does not deform under the effect of stresses when the disconnector is in operation; the stationary contact 4 is suitable for deforming in order to adapt itself to the size of the movable contact 2 in operation. Deformation of the stationary contact 4 may be obtained by virtue of means having elastic properties, for example in this embodiment the flexible tabs 32.2, 32.3 and the coil return springs 34.2, 34.3. Thus, the size of the gap increases when the movable contact 2 penetrates into the stationary contact 4, and it adapts itself to the transverse dimension of the movable contact 2, with this dimension being defined by the distance between the ends of the contact elements 16.1, 16.2 that point radially outwards and that are themselves fastened to the section member 2.

The electrical contact as obtained in this way between the movable conductor 2 of the invention and a stationary contact 4 is of very good quality, even at very high voltages.

Finally, as shown in FIGS. 2A-2C, abutment means along the axis Y may be provided, in order to limit the recoil movement of the section member 2 during an electrical short circuit. These means are formed by the curved end of the arcing horn 36 of the movable contact 2, which is suitable for coming into abutment against one or more spark arresters 31 that are fastened to the part 30 and that extend on either side of the axis Y. This arrangement is shown in FIG. 2B, as seen from above the structure of FIG. 2A.

By means of the arrangement of corrugations or grooves or fluting all around the blade, which corrugations (or grooves, or fluting) become filled with ice and/or snow, the invention makes it possible to heat the ice and/or snow and consequently facilitates the release of such ice (or snow) when operating the disconnector.

Consequently, other things remaining equal, because the ice and/or snow is easily removed, it is possible to avoid over-dimensioning the mechanical parts that are used for actuating the blade. The corrugations (or grooves or fluting)

also serve to lighten the conductor as a result of the convection phenomenon that is used to better advantage with this radiator shape.

The invention makes it possible to reduce the weight of the de-iced conductor compared with a conventional conductor by up to 30% for a high voltage disconnector blade made of aluminum.

The radiator shape of the blade also makes it possible in ice-free (or snow-free) conditions to reduce the weight of the blade by about 30% compared with a prior art blade.

Other improvements or variants may be envisaged without thereby going beyond the ambit of the invention.

As mentioned above, the conductor of the invention is suitable for any type of electrical apparatus for providing intermittent or continuous electrical contact.

In particular, the conductor of the invention may be a stationary contact that is installed once and for ever. In a stationary configuration, when installed in permanent manner, the conductor is suitable for being shaped as a result of its intrinsic flexibility and because of the resilient means for urging apart the contact elements. Its shape can thus adapt as necessary to match other components with which it is electrically connected.

In the event of the conductor serving to connect together electrically two portions of electrical equipment, it may have contact elements at both of its longitudinal ends: the contact elements at one end come into contact with one portion of the electrical equipment, and the contact elements at the other longitudinal end come into contact with the other portion of the electrical equipment. Under such circumstances, current flows in the longitudinal direction and between one longitudinal end and the other.

When the conductor is a movable conductor, the present invention is not limited to a contact that moves in pivoting, but also applies to a contact that is movable in translation and to a contact that is movable in translation and/or in pivoting.

Furthermore, the conductor of the present invention may have more than two contact elements.

The electrical equipment of the present invention is lighter in weight than equipment of the prior art, in particular disconnectors. Because of this reduced weight, the ability of a disconnector of the invention to withstand high levels of seismic stress and to withstand being operated when iced, is increased.

Although described with reference to a section member having 38 corrugations that are exposed to ice and/or snow, a conductor of the invention may be divided with a larger number (or smaller number) of corrugations.

Finally, although all of the corrugations in the example described have the same simple rounded shape, it is possible in the ambit of the invention to provide shapes that are more complex (main corrugations provided with secondary corrugations of the kind to be found in fractal geometries) and of greater length, while also maintaining their ability to be clogged with ice and/or snow in order to encourage heating of the conductor. Furthermore, reducing the weight of the conductor by reducing its right section contributes to increasing its electrical resistance and thus to increasing heating.

It is possible to achieve a reduction in weight of about 30% compared with the members of circular section that are usually used for electrical equipment and for a given current being conveyed by said equipment. As explained above, this reduction in weight of about 30% is naturally advantageous when the electrical equipment is subjected to seismic stresses.

The invention also presents advantages for applications where it is desired to save weight and/or material for a conductor. For example, it may be advantageous to have such a reduction in busbars, i.e. current-conducting bars that connect together various pieces of electrical equipment.

Thus, for copper-based conductors that are normally used, it is possible to make them in accordance with the invention from copper extruded profile, thereby achieving substantial savings in fabrication costs, given the constantly increasing price of copper.

Although the invention is described above with reference to a high voltage electrical equipment, and more specifically for a high voltage disconnector blade, the invention is equally applicable to low voltage or medium voltage equipment, e.g. to busbars.

During operation of a conductor or of electrical equipment or of a disconnector of the invention, current flows from one end to the other of the conductor, thereby generating a Joule effect in its wall. Any ice and/or snow that has accumulated in the corrugations or fluting or grooves will be able to melt effectively, with the help of the effects that are described above.

The invention proposes a conductor of smaller weight in comparison with a conventional conductor for given current and heating threshold, by means of a reduction in the right section of the conductor.

In a conductor of the invention, heating for a given current is less than that in a conventional conductor, even though its electrical resistance is higher because of the reduction in its cross section, with this being the result of its larger convective and/or radiative surface area.

A conductor of the invention presents an acceptable current that is higher than that of a conventional conductor of larger cross section, as a result of its larger convective and/or radiative outer surface area. The conductor is thus well adapted to applications for de-icing by injecting high currents.

The electrical resistance of such a conductor is greater than that of a conventional conductor because of the reduction in its cross section. Thus, the Joule losses that are generated therein when passing a given current are greater, and they therefore enable de-icing to take place more quickly than with a traditional conductor.

The invention claimed is:

1. A high voltage electrical equipment including at least one conductor and at least one electrical contact configured to contact said conductor, the conductor comprising at least one hollow section member of electrically conductive material that is elongated along a longitudinal axis, the conductor having an outside surface in which at least a portion forms corrugations in a plane perpendicular to said longitudinal axis, the conductor including at least one lateral projection extending beyond the outside surface of the conductor in said plane perpendicular to the longitudinal axis, wherein each lateral projection has an outside surface with a portion provided with corrugations in the plane perpendicular to said longitudinal axis.

2. The high voltage electrical equipment according to claim 1, wherein the corrugations form fluting or grooves in the outside surface of said conductor that extend in a direction parallel to the longitudinal axis.

3. The high voltage electrical equipment according to claim 1, wherein the at least one electrical contact element is configured for coming into contact with a distinct electrical contact in order to provide an electrical connection.

4. The high voltage electrical equipment according to claim 1, wherein each lateral projection has an outside surface with a portion that is plane.

5. The high voltage electrical equipment according to claim 1, wherein each lateral projection is provided with a part for providing an electrical contact.

6. The high voltage electrical equipment according to claim 1, wherein said outside surface of said conductor is provided with corrugations that are simple and/or complex.

7. The conductor according to claim 6, wherein the corrugations have a fractal geometry.

8. The high voltage electrical equipment according to claim 1, wherein said at least one hollow section member is formed by extrusion.

9. The high voltage electrical equipment according to claim 1, wherein said at least one hollow section member is made of aluminum or copper or copper alloy.

10. The high voltage electrical equipment according to claim 1, further comprising a pivot hinge at one end of the conductor.

11. A high voltage disconnector including the high voltage electrical equipment according to claim 10 wherein the conductor is mounted by pivotal hinging on an insulating support, wherein said conductor contacts the at least one electrical contact by a pivoting movement.

12. The high voltage electrical equipment according to claim 1, further comprising at least one lateral reinforcement.

13. The high voltage electrical equipment according to claim 1, wherein the at least one electrical contact has a plurality of separate contacts that contacts a common lateral portion of said conductor.

14. The high voltage electrical equipment according to claim 1, wherein said conductor is stationary and said electrical contact is a movable contact.

15. The high voltage electrical equipment according to claim 1, wherein said conductor is movable and said electrical contact is a stationary contact.

16. The electrical equipment according to claim 15, wherein said electrical contact is U-shaped.

17. A high voltage disconnector including the high voltage electrical equipment according to claim 1.

18. An operating method for operating the high voltage electrical equipment according to claim 1, comprising a step of:

inducing current flow between opposite ends of the conductor wherein a Joule effect is created in walls of the conductor.

19. The operating method according to claim 18, wherein the conductor is configured to melt ice and/or snow accumulated in the corrugations of the conductor.

20. A high voltage electrical equipment including at least one conductor and at least one electrical contact configured to contact said conductor, the conductor comprising:

at least one hollow section member of electrically conductive material that is elongated along a longitudinal axis, the conductor having an outside surface in which at least a portion forms corrugations in a plane perpendicular to said longitudinal axis, wherein said conductor is movable and said electrical contact is a stationary contact, and said electrical contact being U-shaped wherein each branch of the U-shaped electrical contact includes at least one stationary contact extended by a tab folded inwards so as to be substantially parallel to the branch of the U-shaped electrical contact from which the tab extends, said tab configured to come into mechanical contact with at least one contact element of the movable conductor.

21. The high voltage electrical equipment according to claim 20, wherein return elements are interposed between the tab and the branch of the U-shaped electrical contact from which the tab extends, in order to urge the tab inwards towards the movable conductor when the movable conductor is in contact with the stationary contact.

* * * * *